US009051791B2

(12) United States Patent
Fayo et al.

(10) Patent No.: US 9,051,791 B2
(45) Date of Patent: Jun. 9, 2015

(54) TUBING CENTRALIZER

(75) Inventors: Johnny B. Fayo, Odessa, TX (US); Ricky Wayne Jackson, Midland, TX (US); Mark Nease, Odessa, TX (US); Scott William Long, Midland, TX (US)

(73) Assignee: Delaware Capital Formation, Inc., Wilmington, DE (US)

( * ) Notice: Subject to any disclaimer, the term of this patent is extended or adjusted under 35 U.S.C. 154(b) by 339 days.

(21) Appl. No.: 13/541,078

(22) Filed: Jul. 3, 2012

(65) Prior Publication Data

US 2014/0008056 A1 Jan. 9, 2014

(51) Int. Cl.
*E21B 17/10* (2006.01)

(52) U.S. Cl.
CPC ..... *E21B 17/1028* (2013.01)

(58) Field of Classification Search
CPC . E21B 17/10; E21B 17/1014; E21B 17/1028; E21B 17/1021; E21B 17/1078
USPC ..... 166/241.6, 241.1, 382
See application file for complete search history.

(56) References Cited

U.S. PATENT DOCUMENTS

| | | | | | |
|---|---|---|---|---|---|
| 1,801,334 | A * | 4/1931 | Dalldorf et al. | ..... | 166/213 |
| 1,835,377 | A * | 12/1931 | Clark et al. | ..... | 166/135 |
| 2,656,890 | A * | 10/1953 | Brandon | ..... | 166/241.6 |
| 3,556,042 | A * | 1/1971 | Laughlin | ..... | 166/241.7 |
| 3,566,965 | A * | 3/1971 | Solum | ..... | 166/241.7 |
| 4,219,081 | A | 8/1980 | Howe | | |
| 4,531,582 | A | 7/1985 | Muse | | |
| 8,245,777 | B2 | 8/2012 | Garner | | |
| 2002/0139538 | A1 * | 10/2002 | Young et al. | ..... | 166/380 |
| 2009/0008086 | A1 | 1/2009 | Ehlinger | | |
| 2010/0018698 | A1 * | 1/2010 | Garner | ..... | 166/241.6 |
| 2010/0078173 | A1 | 4/2010 | Buytaert | | |
| 2012/0145410 | A1 * | 6/2012 | Levie | ..... | 166/382 |

FOREIGN PATENT DOCUMENTS

| | | | | |
|---|---|---|---|---|
| WO | 9853178 | 11/1998 | | |
| WO | WO 9853178 A1 * | 11/1998 | ..... | E21B 17/10 |

* cited by examiner

*Primary Examiner* — Kenneth L Thompson
*Assistant Examiner* — David Carroll
(74) *Attorney, Agent, or Firm* — Head, Johnson & Kachigian, P.C.

(57) ABSTRACT

The present invention is a tubing centralizer for use within casing within a wellbore. The tubing centralizer has a tubing centralizer cage comprising a top ring, a middle ring, and a bottom ring and a plurality of springs, where each spring connects the top ring to the middle ring and the middle ring to the bottom ring and where each spring has a double arcuate shape such that the springs arc radially outward between the top ring and the middle ring and again between the middle ring and the bottom ring. The springs may be sized such that they exert outward pressure against the inside wall of the casing such that the tubing centralizer resists movement along the casing. The tubing centralizer may further comprise a tubing centralizer mandrel, where the tubing centralizer mandrel is part of the tubing string and extends through the tubing centralizer cage.

16 Claims, 5 Drawing Sheets

FIG. 4
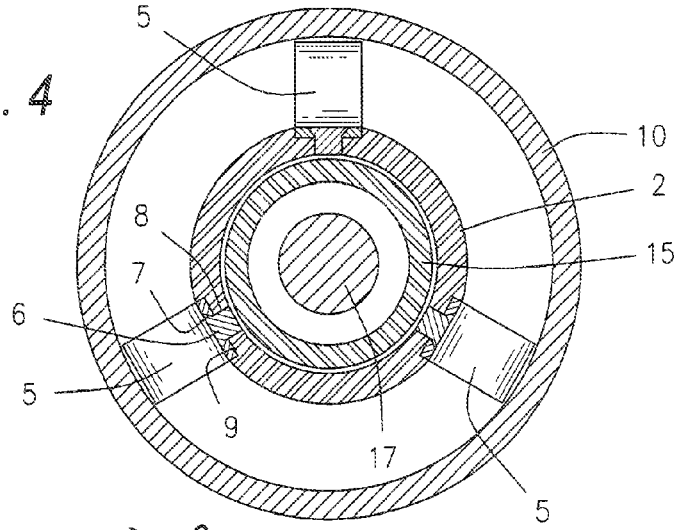
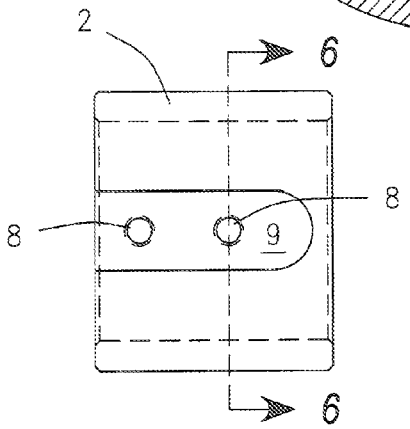
FIG. 5
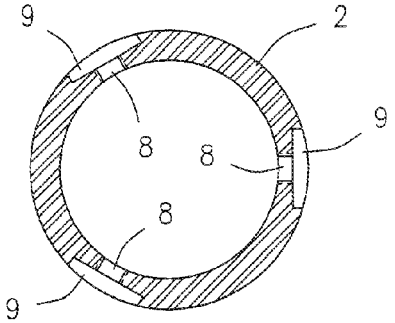
FIG. 6
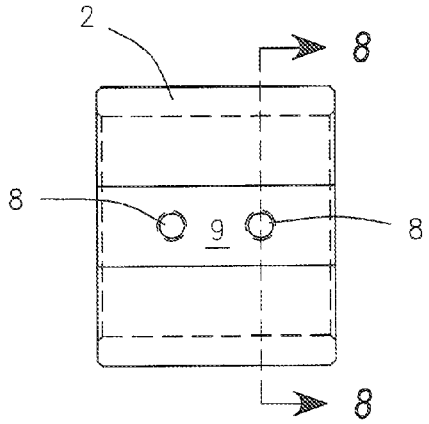
FIG. 7
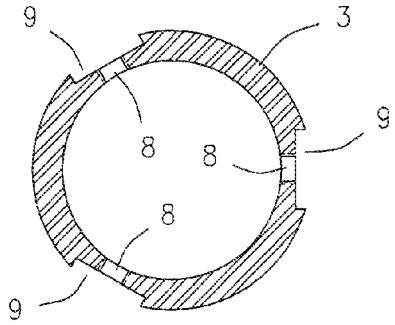
FIG. 8

TUBING CENTRALIZER

CROSS REFERENCE

Not Applicable.

BACKGROUND OF THE INVENTION

1. Field of the Invention

This invention relates generally to a tubing centralizer, and more particularly, but not by way of limitation, to a tubing centralizer having a double spring cage with a close tolerance with the inside diameter of a tubing casing.

2. Description of the Related Art

When a subterranean well is drilled, the wellbore is often "cased" or lined with steel pipe called casing to keep the formation from caving in and filling the wellbore. When casing is installed across the producing formation, the desired casing interval will often be perforated to allow the produced fluids to enter the wellbore to be produced to the surface.

A tubing string of smaller diameter is then installed in the cased wellbore and "hung" in the wellhead at the surface. A joint of tubing is typically 31.5' in length and is joined together in end to end fashion utilizing tubing couplings. The top end of the tubing string is attached in the wellhead and the bottom end can be attached to a downhole tubing anchor catcher ("TAC"). The tubing string is a downhole pipeline between the downhole pump and the wellhead. The tubing string helps transport the produced fluids from the producing reservoir through perforations in the casing up to the surface and subsequently into storage and sales tanks.

The rodstring and downhole pump is then installed within the tubing string. The downhole pump is installed in the pump seating nipple located in the bottom of the tubing string. The rodstring is the connection between the downhole pump and the pumping unit at the surface. The reciprocating motion of the horse head of the pumping unit and the connected rodstring actuates the downhole pump, lifting produced fluids up the tubing within the space between the tubing string and the rodstring.

If the tubing string is installed without a tubing anchor catcher, the reciprocating movement of the rodstring inside the tubing string may cause the tubing string to move with the reciprocating movement of the rodstring. This movement of the tubing string can reduce the length of the downhole pump stroke reducing the volume of produce fluids the downhole pump can lift to the surface through the tubing string. This movement of the tubing can contribute to the following downhole issues:

1. The exterior wall of the tubing can contact the interior wall of the casing and wear a hole in the casing, resulting in a casing leak. This casing leak allows formation fluids to enter the producing wellbore, damaging all components of the downhole lift system.
2. The exterior wall of the tubing can make contact with the interior wall of the casing and wear a hole in the tubing string, resulting in a tubing leak. This "exterior" tubing leak allows fluids from the tubing to flow into the tubing-casing annulus, reducing the lift capability of the downhole pump.
3. The rodstring can make contact with the interior wall of the tubing and wear a hole in the tubing string, resulting in a tubing leak. This "interior" tubing leak allows fluids from the tubing to flow into the tubing-casing annulus, reducing the lift capacity of the downhole pump.
4. The rodstring can make contact with the interior wall of the tubing and wear the outside surface diameter of the rodstring until the rodstring can no longer support the fluid load produced by the downhole pump. The rodstring then separates, resulting in a rod failure. A rod failure stops the rodstring from lifting fluids from the pump to the surface.

Tubing anchor catchers can be installed in wells to reduce the above-mentioned tubing movement of the tubing string during producing operations. Tubing anchor catchers are installed in the tubing string and actuated to secure the tubing anchor catcher to the interior casing wall. Once the tubing anchor catcher is set, the tubing string is stretched to place the tubing string between the tubing anchor catcher and the wellhead in tension. This tension should eliminate all tubing movement of the tubing between the tubing anchor catcher and the wellhead.

Eliminating this tubing movement should reduce the frequency of the four (4) downhole failures mentioned above.

When the tubing anchor catcher is located above the pump, there can still be movement of the tubing string between the location of the tubing anchor catcher and the downhole pump. This remaining tubing string movement below the tubing anchor catcher may still produce possible casing leaks, tubing leaks, rod failures, and reduced production of wellbore fluids to surface.

Operators prefer to install tubing anchor catchers as close above the top perforation of the top producing interval as possible to avoid formation solids from entering the wellbore, settling on top of the tubing anchor catcher, and sticking or "planting" the tubing anchor catcher in the casing.

When the producing interval (the distance between the top and bottom perforation) in a producing well is short, the tubing anchor catcher is usually installed above the top perforation and the pump is installed near the bottom perforation. Installing the downhole pump below the perforations also allows formation gas to produce into the tubing casing annulus instead of moving through the pump, causing gas interference and reducing the efficiency of the pump to lift fluids up to the surface.

A short distance between the pump and the tubing anchor catcher minimizes tubing movement, which can cause casing leaks, tubing leaks, and rod failures and increases the lift capability of the downhole pump.

When the producing interval is longer because of (1) a large single producing zone, (2) multiple producing zones resulting in a large producing interval, (3) the addition of new producing zones, or (4) horizontal or deviated wellbores, the tubing anchor catcher can also be installed above the top perforation and the pump installed near the bottom perforation. This longer un-anchored tubing section can still cause reduced lift efficiency of the downhole pump, resulting in reduced volumes of wellbore fluids, increased tubing movement between tubing anchor catcher and downhole pump, and the increased possibility of casing leaks, tubing leaks, and rod failures.

Based on the foregoing, it is desirable to provide a tubing centralizer that can be installed between the tubing anchor catcher and the seating nipple of the downhole pump in a tubing string to help centralize the tubing string within the casing string and reduce movement of the tubing string. This would reduce tubing-on-casing contact and rod-on-tubing contact, reduce casing leaks, reduce tubing leaks, and reduce rod failures. Furthermore, reducing the length of unanchored tubing will help maximize the volume of produced wellbore fluids.

SUMMARY OF THE INVENTION

In general, in a first aspect, the invention relates to a tubing centralizer for use within casing within a wellbore. The tubing centralizer comprises a tubing centralizer cage, which comprises a top ring, a middle ring, and a bottom ring and a plurality of springs, where each spring connects the top ring to the middle ring and the middle ring to the bottom ring and where each spring has a double arcuate shape such that the springs arc radially outward between the top ring and the middle ring and again between the middle ring and the bottom ring.

The springs may be shaped such that the rings are spaced such that the middle ring is equidistant from the top right and from the bottom ring. The plurality of springs may be three springs, and the three springs may be spaced 120° from each other on the rings such that the springs are evenly spaced. The springs may be attached to the rings via attaching elements. The attaching elements may be screws, the springs may have bores through which the screws extend, and the rings may have threaded bores into which the screws may be tightened. Each of the springs may be attached to each of the rings at two points. The rings may each have recesses into which the springs fit such that the springs are countersunk and the rings with the springs attached each have a consistent outer diameter. The rings may be connected to each other only via the springs.

The casing may have inside walls and the springs may be sized such that the springs exert outward pressure against the inside walls of the casing such that the tubing centralizer resists movement along the casing.

The tubing centralizer may further comprise a tubing centralizer mandrel, where the tubing centralizer mandrel extends through the top ring, middle ring, and bottom ring of the tubing centralizer cage. The tubing centralizer mandrel may have two ends and the two ends of the tubing centralizer mandrel may be threaded such that they accept standard tubing collars. The tubing centralizer mandrel may have a length and an outside diameter that is consistent along the length of the tubing centralizer mandrel. There may be a close tolerance between the tubing centralizer mandrel and the rings of the tubing centralizer cage. The tubing centralizer mandrel may be capable of moving up and down within the tubing centralizer cage. The tubing centralizer may further comprise a tubing collar attached to the tubing centralizer mandrel where the tubing collar is sized such that the tubing collar cannot travel through the tubing centralizer cage.

The tubing centralizer may be used in a downhole assembly comprising: casing with an inside wall; a tubing string; a tubing anchor catcher; a downhole pump located below the tubing anchor catcher; and a tubing centralizer located between the tubing anchor catcher and the downhole pump. The tubing centralizer may comprise: a tubing centralizer cage comprising: a top ring, a middle ring, and a bottom ring and a plurality of springs, where each spring connects the top ring to the middle ring and the middle ring to the bottom ring and where each spring has a double arcuate shape such that the springs arc radially outward between the top ring and the middle ring and again between the middle ring and the bottom ring, and where the springs are sized such that the springs exert outward pressure against the inside wall of the casing such that the tubing centralizer resists movement along the casing; and a tubing centralizer mandrel, where the tubing centralizer mandrel is part of the tubing string and extends through the tubing centralizer cage.

BRIEF DESCRIPTION OF THE DRAWINGS

FIG. 4 is a cross section view of the casing, tubing, centralizer cage, tubing centralizer mandrel, and sinkerbar;

FIG. 5 is a side view of one of the end rings of the tubing centralizer cage, showing the recess for the spring to attach thereto;

FIG. 6 is a cross section view of one of the end rings of the tubing centralizer cage, showing the recess for the spring to attach thereto;

FIG. 7 is a side view of the middle ring of the tubing centralizer cage, showing the recess for the spring to attach thereto;

FIG. 8 is a cross section view of the middle ring of the tubing centralizer cage, showing the recess for the spring to attach thereto.

Other advantages and features will be apparent from the following description and from the claims.

DETAILED DESCRIPTION OF THE INVENTION

The devices and methods discussed herein are merely illustrative of specific manners in which to make and use this invention and are not to be interpreted as limiting in scope.

While the devices and methods have been described with a certain degree of particularity, it is to be noted that many modifications may be made in the details of the construction and the arrangement of the devices and components without departing from the spirit and scope of this disclosure. It is understood that the devices and methods are not limited to the embodiments set forth herein for purposes of exemplification.

Figure 1:
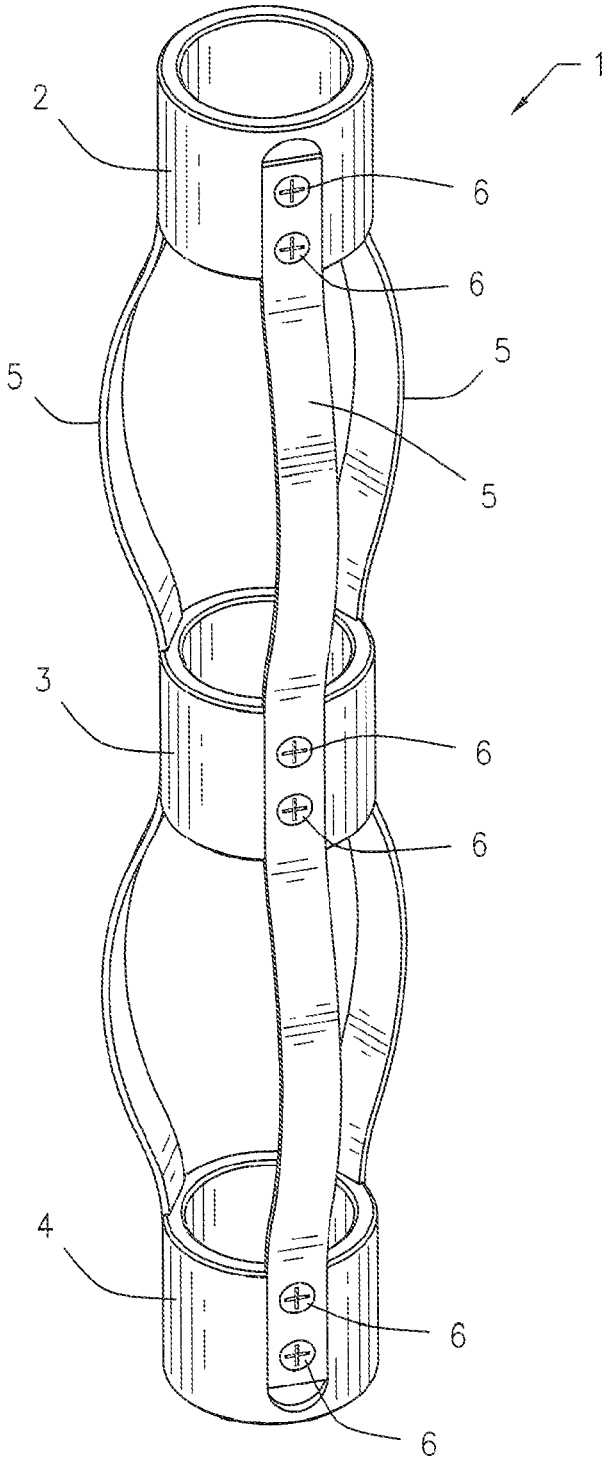
FIG. 1 is a perspective view of a tubing centralizer cage constructed in accordance with the present invention.

In general, in a first aspect, the invention relates to a tubing centralizer shown in FIGS. 1 through 9. The tubing centralizer comprises a tubing centralizer cage 1, as shown in FIG. 1. The tubing centralizer cage 1 may have a top ring 2, a middle ring 3, and a bottom ring 4. A plurality of springs 5 may extend from top ring 2 to middle ring 3 and then to bottom ring 4. Each of the springs 5 may have a double arcuate shape, such that they arc radially outward between rings 2 and 3 and again between rings 3 and 4.

The springs 5 may be formed such that the rings 2, 3, and 4 may be spaced such that the top middle ring 3 is approximately equidistant from the top ring 2 and the bottom ring 4. Each of the springs 5 may be continuous, formed of a single piece of material. As seen in FIG. 1, the tubing centralizer cage 1 may have three springs 5; if so, the springs may be attached 120 degrees from each other on the rings 2, 3, and 4 such that they are evenly spaced.

Figure 2:
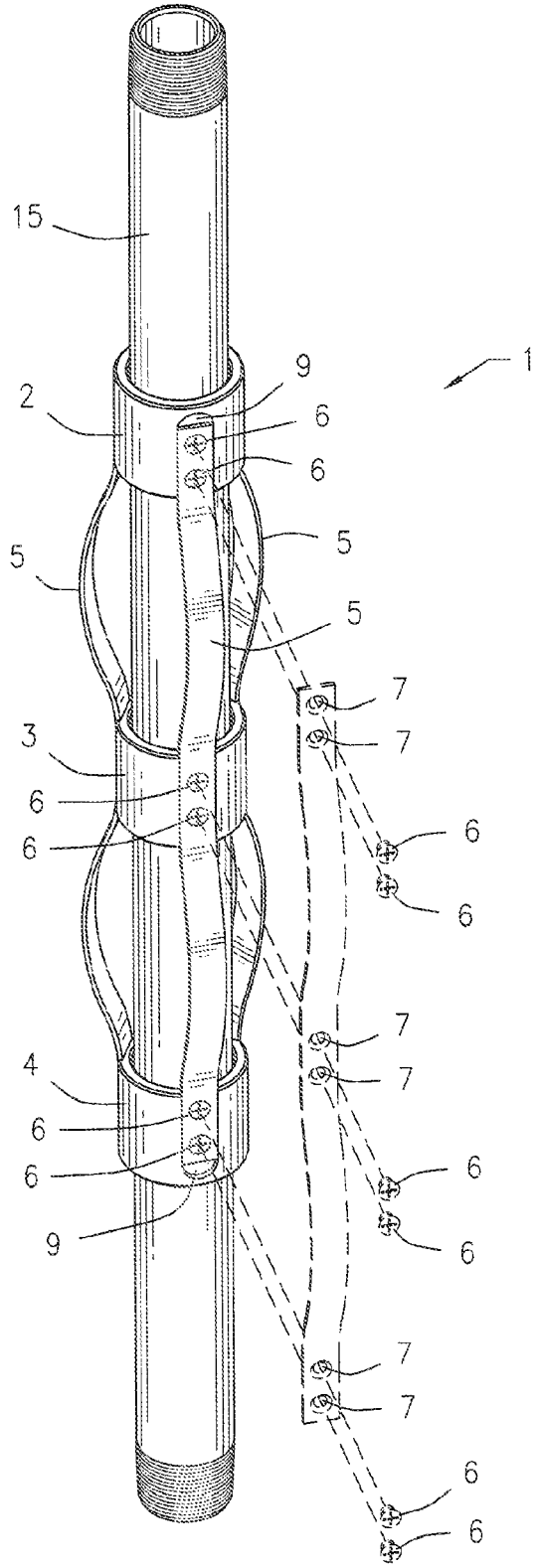
FIG. 2 is a perspective view of the tubing centralizer cage shown in FIG. 1 in place on a tubing centralizer mandrel, showing how the springs of the tubing centralizer cage attach to the rings of the tubing centralizer cage.

As seen in FIGS. 1 and 2, the springs 5 may attach to the rings 2, 3, and 4 via attaching elements 6, such as screws. If the attaching elements 6 are screws, the springs 5 may have bores 7 through which the attaching elements 6 may extend and rings 2, 3, and 4 may have threaded bores 8 into which the attaching elements 6 may be tightened. Each of the springs 5 may attach to each of the rings 2, 3, and 4 at two points via two attaching elements 6. The rings 2, 3, and 4 may have recessed areas 9 into which the springs 5 may fit such that the springs 5 are countersunk at the attachment locations to minimize high contact loading of all six attaching elements 6 with the inside diameter of the casing. As seen in FIGS. 7 and 8, the recessed areas 9 on the middle ring 3 may extend the full height of the ring 3, as the springs 5 must extend from the ring 3 in both directions. As seen in FIGS. 5 and 6, the recessed areas 9 on the top ring 2 and bottom ring 4 may extend only partially along the height of the ring 2 and 4, as the springs 5 terminate at the rings 2 and 4. In FIGS. 5 and 7, horizontal dashed lines may indicate the inner bore of the rings 2 and 3, while vertical dashed lines may indicate beveling.

As seen in FIG. 1, the three rings 2, 3, and 4 may be independent of each other, save for their connection via the springs 5. The three rings 2, 3, and 4 may not form a solid, continuous, and cylindrical centralizer body. Thus, the tubing centralizer cage 1 may provide fluid movement through the non-restricting areas located between each of the independent rings 2, 3, and 4. These non-restricting areas may be terminated by each ring 2, 3, and 4 rather than being extended lengthwise between opposing ends of a centralizer body. The top ring 2 and bottom ring 4 may be beveled on their outside edges to minimize damage to the production casing and collars during installation and during production operations.

The openness of the tubing centralizer cage 1 may minimize the impact of solids becoming lodged within the cage 1. The openness of the tubing centralizer cage 1 may also increase the possibility of solids being washed from the cage 1 from the normal movement of wellbore fluids during artificial lift operations. Additionally, the openness of the tubing centralizer cage 1 may allow fluid shot equipment to better calculate and estimate fluid levels. A more closed design may reflect the acoustic wave produced by the fluid shot equipment indicating a false fluid level caused by the tubing centralizer.

Figure 3:
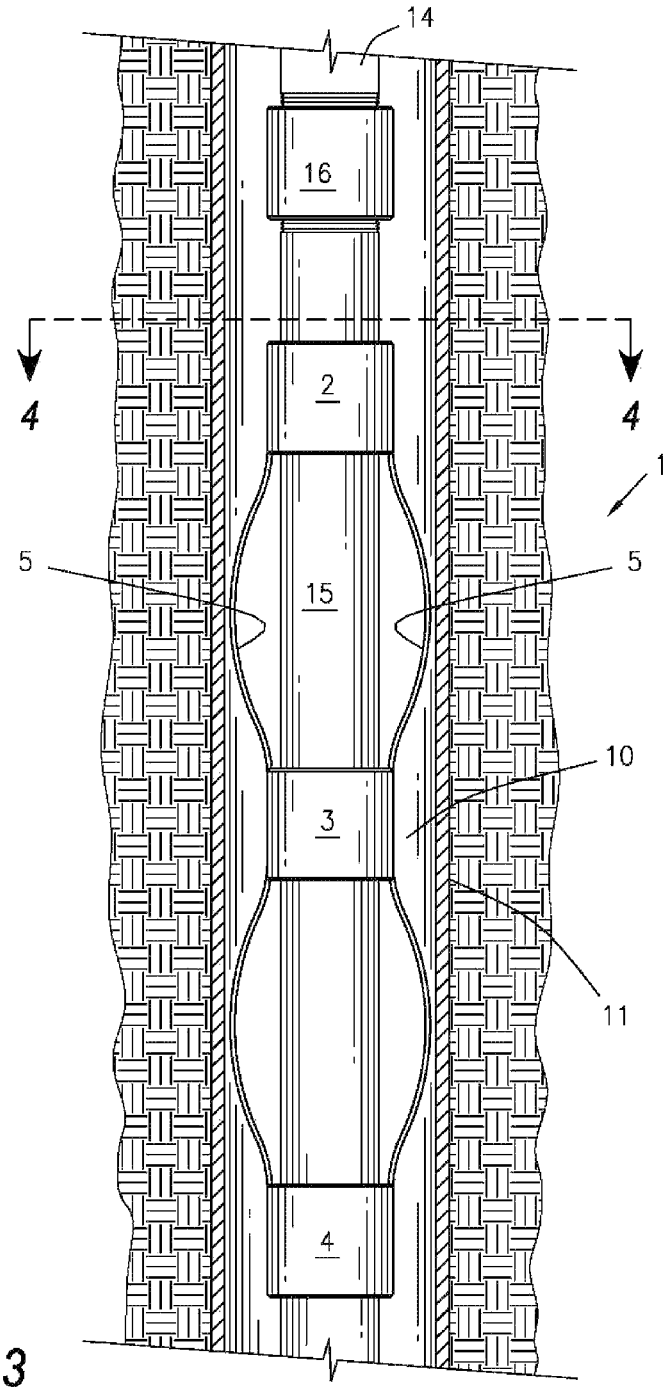
FIG. 3 is a side cut-away view of the tubing centralizer in place within casing within a wellbore.
Figure 9:
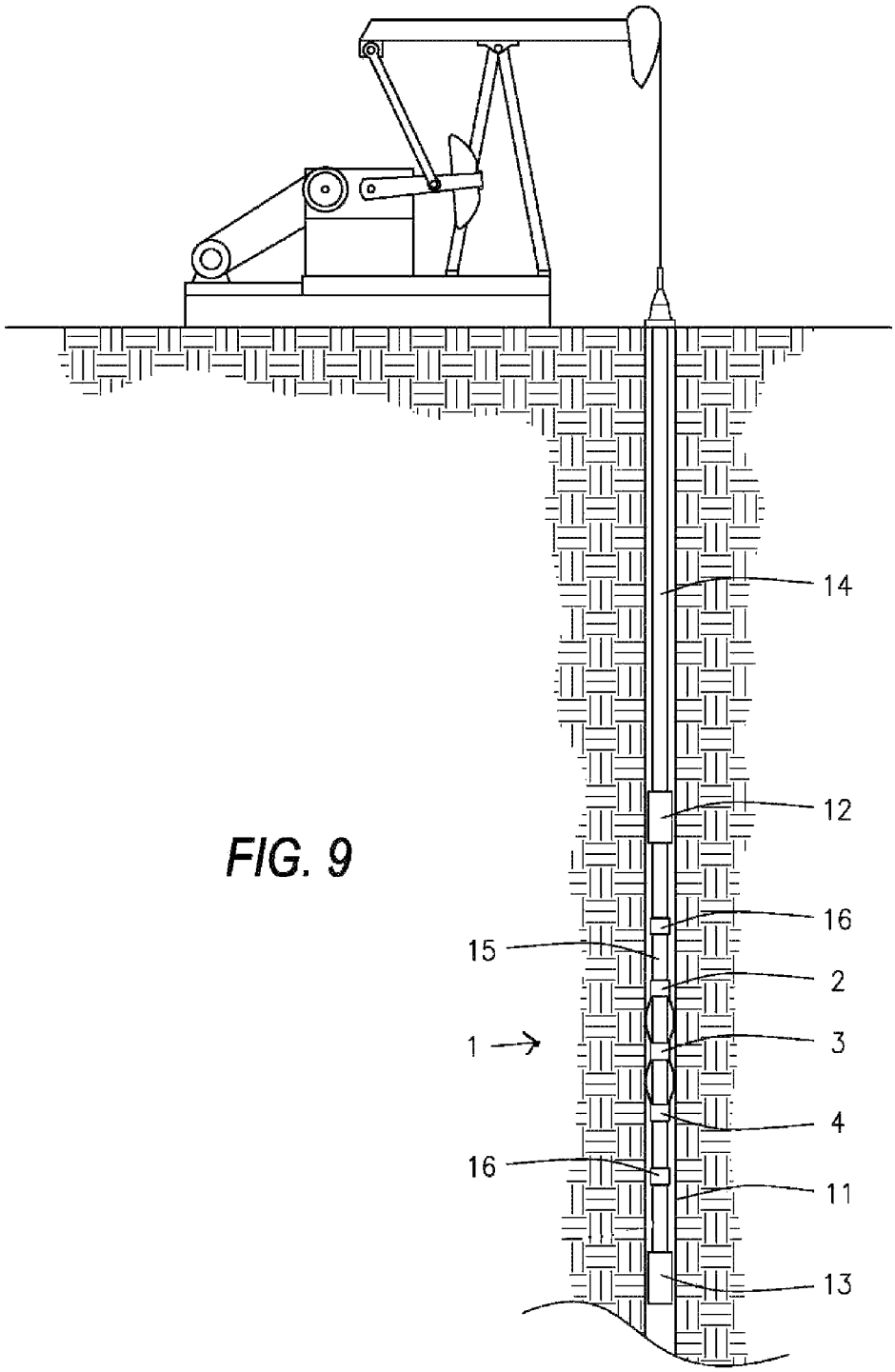
FIG. 9 is a side cut-away view of the tubing centralizer in place within casing within a wellbore, where the tubing centralizer is between a tubing anchor catcher and a seating nipple for a downhole pump.

The tubing centralizer cage 1 may be placed within casing within a wellbore 11. As seen in FIG. 9, the tubing centralizer cage 1 may be located between a tubing anchor catcher 12 and a downhole pump 13 within a seating nipple, or elsewhere along the tubing string 14. As seen in FIG. 3, the springs 5 may be sized such that they exert outward pressure against the inside walls of the casing 10. Thus, the tubing centralizer cage 1 resists vertical movement along the casing 10. When there are three springs 5, the tubing centralizer cage 1 contacts the wall of the casing 10 at six points. This allows for greater opportunity for the tubing centralizer cage 1 to maintain contact with the casing 10. The double spring formation also incorporates increased spring constants to insure that the tubing centralizer cage 1 does not move while secured to the wall of the casing 10.

During installation, the springs 5 may flex, increasing the distance between the rings 2 and 3 and between the rings 3 and 4 and decreasing the diameter of the tubing centralizer cage 1, allowing the tubing centralizer cage 1 to be placed at the correct level within the casing 10. Once in place, the springs 5 attempt to return to their normal shape, thus exerting the previously discussed outward pressure against the inside walls of the casing 10. Tubing running through the tubing centralizer cage 1 is thus prevented from contacting the inner walls of the casing 10, reducing wear on the casing 10 and the tubing string 14.

The tubing centralizer may further comprise a tubing centralizer mandrel 15, as shown in FIGS. 2 and 3. The tubing centralizer mandrel 15 may be a custom machined mandrel that replaces a standard tubing sub that is typically used in existing centralizers. The tubing centralizer mandrel 15 may run vertically through the three rings 2, 3, and 4 of the tubing centralizer cage 1. Both ends of the tubing centralizer mandrel 15 may be threaded to accept standard tubing collars 16. The tubing collars 16 may connect the tubing centralizer mandrel 15 to the rest of the tubing string 14.

The outside diameter of the tubing centralizer mandrel 15 may be continuous the full length of the mandrel 15. This feature eliminates the neck down area found at both ends of a standard tubing sub. This constant tubing outside diameter of the mandrel 15 provides a closer and more constant spacing tolerance between the outer diameter of the mandrel 15 and the inner diameter of the rings 2, 3, and 4. This more controlled tolerance minimizes the lateral movement and wear of the tubing centralizer cage 1 on the mandrel 15 during operation.

The tubing centralizer cage 1 and the mandrel 15 may be installed simultaneously.

With the tubing centralizer cage 1 secured to the inside diameter of the casing 10, the mandrel 15 may be designed to move up and down within the tubing centralizer cage 1. The mandrel 15 may be of sufficient length that the tubing collars 16 at either end of the mandrel 15 do not come into contact with the tubing centralizer cage 1. For example, the mandrel 15 may be 26 inches in length. This minimizes longitudinal cage movement and therefore minimizes possible casing wear caused by movement of the tubing centralizer cage 1 on the wall of the casing 10. Should the mandrel 15 travel further, the tubing collars 16 may prevent further movement of the mandrel through the tubing centralizer cage 1. Sinkerbar 17 may travel through the tubing string 14, including through the tubing centralizer mandrel 15, as seen in FIG. 4.

Whereas, the devices and methods have been described in relation to the drawings and claims, it should be understood that other and further modifications, apart from those shown or suggested herein, may be made within the spirit and scope of this invention.

What is claimed is:

1. A tubing centralizer for use within casing within a wellbore with a tubing string therein, the tubing centralizer comprising:

a tubing centralizer cage comprising:

a top ring, a middle ring, and a bottom ring, with tubing passing through each said ring; and a plurality of springs, where each spring connects the top ring to the middle ring and the middle ring to the bottom ring and where each spring has a double arcuate shape such that the springs arc radially outward between the top ring and the middle ring and again between the middle ring and the bottom ring.

2. The tubing centralizer of claim 1 where the springs are shaped such that the rings are spaced such that the middle ring is equidistant from the top ring and from the bottom ring.

3. The tubing centralizer of claim 1 where the plurality of springs is three springs, and the three springs are spaced 120° from each other on the rings such that the springs are evenly spaced around the rings.

4. The tubing centralizer of claim 1 where the springs are attached to the rings via attaching elements.

5. The tubing centralizer of claim 4 where the attaching elements are screws, the springs have bores through which the screws extend, and the rings have threaded bores into which the screws may be tightened.

6. The tubing centralizer of claim 1 where each of the springs is attached at two points to each of the rings.

7. The tubing centralizer of claim 1 where the rings each have recesses into which the springs fit such that the springs are countersunk and the rings with the springs attached each have a consistent outer diameter.

8. The tubing centralizer of claim 1 where the rings are connected to each other only via the springs.

9. The tubing centralizer of claim 1 where the casing within the wellbore has inside walls and where the springs are sized such that the springs exert outward pressure against the inside walls of the casing such that the tubing centralizer resists movement along the casing.

10. The tubing centralizer of claim 1, wherein the tubing passing through said rings is a tubing centralizer mandrel, where the tubing centralizer mandrel extends through the top ring, middle ring, and bottom ring of the tubing centralizer cage.

11. The tubing centralizer of claim 10, where the tubing centralizer mandrel has two ends and the two ends of the tubing centralizer mandrel are threaded such that they accept standard tubing collars.

12. The tubing centralizer of claim 10 where the tubing centralizer mandrel has a length and an outside diameter that is consistent along the length of the tubing centralizer mandrel.

13. The tubing centralizer of claim 10 where there is a close tolerance between the tubing centralizer mandrel and the rings of the tubing centralizer cage such that said close tolerance minimizes radial movement of said mandrel within said rings while permitting axial movement of said mandrel within said rings.

14. The tubing centralizer of claim 10 where the tubing centralizer mandrel is capable of moving up and down within the tubing centralizer cage.

15. The tubing centralizer of claim 10 further comprising a tubing collar attached to the tubing centralizer mandrel where the tubing collar cannot travel through the tubing centralizer cage.

16. A downhole assembly comprising:

casing with an inside wall;

a tubing string within said casing;

a tubing anchor or tubing anchor catcher;

a downhole pump located below the tubing anchor catcher; and a tubing centralizer located between the tubing anchor or tubing anchor catcher and the downhole pump, where the tubing centralizer comprises:

a tubing centralizer cage comprising:

a top ring, a middle ring, and a bottom ring; and a plurality of springs, where each spring connects the top ring to the middle ring and the middle ring to the bottom ring and where each spring has a double arcuate shape such that the springs arc radially outward between the top ring and the middle ring and again between the middle ring and the bottom ring, and where the springs are sized such that the springs exert outward pressure against the inside wall of the casing such that the tubing centralizer resists movement along the casing; and a tubing centralizer mandrel, where the tubing centralizer mandrel is part of or connected to the tubing string and extends through each said ring of the tubing centralizer cage.

* * * * *